US006276824B1

(12) United States Patent
De Jager

(10) Patent No.: US 6,276,824 B1
(45) Date of Patent: Aug. 21, 2001

(54) APPARATUS AND METHOD FOR SLURRYING WASTE MATERIALS AND DRILL CUTTING IN A TANK AND TRANSFERRING THEM THEREFROM

(76) Inventor: Vernon De Jager, Burgmuir Place, Blackhall Industrial Estate, Inverurie (GB), AB51 4FW ( * ) Notice: Subject to any disclaimer, the term of this patent is extended or adjusted under 35 U.S.C. 154(b) by 0 days.

(21) Appl. No.: 09/461,614

(22) Filed: Dec. 15, 1999

(51) Int. Cl.[7] ..... B01F 5/12; B01F 15/02

(52) U.S. Cl. ..... 366/195; 366/196; 366/262; 366/345; 366/346

(58) Field of Search ..... 366/196, 195, 366/194, 190, 184, 262, 263, 265, 270, 261, 285, 286, 331, 332, 345, 346, 136, 137; 210/525, 526, 527, 524, 523; 166/177.7; 175/66, 206, 207

(56) References Cited

U.S. PATENT DOCUMENTS

| | | | |
|---|---|---|---|
| 3,446,151 | | 5/1969 | Andersson . |
| 3,483,984 | | 12/1969 | Wolkenhauer . |
| 3,905,725 | * | 9/1975 | Johnson . |
| 4,152,125 | * | 5/1979 | Pettye . |
| 4,212,548 | * | 7/1980 | Miyaguchi et al. . |
| 4,511,257 | * | 4/1985 | Roberts . |
| 4,572,675 | * | 2/1986 | Roberts . |
| 4,775,070 | | 10/1988 | Williams . |
| 5,413,460 | | 5/1995 | Wilson et al. . |
| 5,490,920 | * | 2/1996 | Fruchtbaum et al. . |
| 5,662,807 | | 9/1997 | Angelle . |
| 5,846,440 | | 12/1998 | Angelle . |

FOREIGN PATENT DOCUMENTS

| | | | |
|---|---|---|---|
| 543502 | * | 7/1957 | (CA) ..... 366/263 |
| 1678452 | | 1/1970 | (DE) . |
| 2817301 | | 10/1979 | (DE) . |
| 3323652 | | 10/1984 | (DE) . |
| 29608236 | | 8/1996 | (DE) . |
| 2298679 | | 9/1996 | (GB) . |
| WO 94/10448 | | 5/1994 | (WO) . |

* cited by examiner

*Primary Examiner*—Tony G. Soohoo
(74) *Attorney, Agent, or Firm*—Finnegan, Henderson, Farabow, Garrett & Dunner, L.L.P.

(57) ABSTRACT

An apparatus and method for slurrying waste materials and drill cuttings. The apparatus includes a pump having a chamber an inlet opening into the bottom of the chamber, an impeller, an outlet on one side of the chamber for removal of material into a discharge line, and circumferentially spaced circulation ports in the chamber side. The impeller extends below the chamber and breaks up debris in addition to drawing material into the pump chamber. The pump may be rotated by a swivel connection and moved and manipulated in the tank by a crane arm, or it may be suspended by cable or other means. The pump stirs up a slurry by rotating the impeller, opening the circulation ports at least partially so that the material entering the bottom inlet to the chamber and being agitated by the impeller is forced out of the circulation ports. The pump can operate in the stirring mode until the material to be removed is generally homogenious, whereupon the circulation ports can be closed allowing the impeller to direct the slurry through the side outlet of the chamber into the discharge line. The stirring or slurrying mode can be combined with a discharge mode by opening the circulation ports as required to slurrify the material while it is pumped out the discharge line. An auxiliary discharge conduit may also be connected with the outlet to discharge material back into the tank to exchange upper fluid layers with lower layers.

21 Claims, 6 Drawing Sheets

APPARATUS AND METHOD FOR SLURRYING WASTE MATERIALS AND DRILL CUTTING IN A TANK AND TRANSFERRING THEM THEREFROM

CROSS-REFERENCE TO RELATED APPLICATION

This invention claims priority of British Provisional Patent Application No. 9827871.6, filed on Dec. 18, 1998 and British Provisional Patent Application No. 9909757.8, filed on Apr. 29, 1999.

BACKGROUND OF THE INVENTION

1. Field of the Invention

This invention relates generally to apparatus and methods for handling drilling waste generated in offshore drilling operations. More particularly, but not by way of limitation, this invention relates to an environmentally safe apparatus and method for slurrying waste materials and drill cuttings in a tank and transferring the waste materials and drill cuttings from the tank to other tanks or containers which is particularly suited for offshore drilling operations as well as land based operations.

2. Brief Description of the Prior Art

In the process of drilling oil and gas wells, a wellbore is drilled into the earth many thousands of feet which generates large amounts of waste material known as drill cuttings that are comprised of rock, dirt, shale and other debris. To prevent damage to the drill bit and to clear the wellbore of the drilled material, these drill cuttings are conveyed to the surface of the well bore by the drilling fluid. The waste material and drill cuttings are then separated from the drilling fluid at the surface and the drilling fluid is returned to the system and is reused while the waste material and drill cuttings are disposed of.

Because the waste material and drill cuttings contain chemicals, hydrocarbons such as oil, and other components hazardous to the environment, environmental regulations require that the waste material and drill cuttings be disposed of in an environmentally acceptable manner and prohibit disposal by dumping the materials into the sea.

Typical environmentally acceptable disposal methods include; re-injecting the waste material and drill cuttings into the earth down an injection well located at the drilling platform or at a remote location, treating the material in an accepted treatment facility usually located away from the drilling rig, or disposing of the material in a land fill location. The volume of drill cuttings generated while drilling a well bore is quite large and consists of several tons of waste material. Thus, the disposal of waste material and drill cuttings represent a major operation and expense.

Contaminated waste materials and drill cuttings recovered from an offshore drilling rig typically require removal from the rig or wellbore for treatment on land to decontaminate them before they can be disposed of safely. Because the volume of the waste material and drill cuttings can be very large, the transport of waste materials and drill cuttings from an offshore rig to a suitable decontamination facility is also a major operation.

In a conventional offshore operation, the waste material and drill cuttings are caught in small containers, known as skips, on the drilling rig, which are then lifted by a crane and loaded on a boat, transported in to a shore base facility, offloaded from the boat by a crane, dumped into a larger storage container to await processing, and then transported to a process facility. Many skips are necessary on a typical drilling rig to handle the large amount of drill cuttings generated. Dedicated crews are necessary to handle the skips on the drilling rig and at the shore base facility, cleaning crews are necessary to clean the skips after each use, safety and environmental concerns have to be addressed in each operation handling the skips. The use of skips interferes with and slows down the drilling process and creates a major environmental concern due lo the possibility of spillage. During inclement weather conditions the skips cannot be loaded on and offloaded from the boats and this, at times, stops the drilling process and increases the dangers associated with skip handling.

On offshore drilling rigs, the shale shakers and solids control equipment are permanently mounted inside enclosed structures, thus the rig has severe space limitations for the installation of additional equipment and access to the areas around the existing shale shakers and solids control equipment is limited. An offshore drilling rig also has holding tanks known as "mud pits", that are permanently installed and part of the rig sub-structure, which are used to store drilling waste and drill cuttings.

Another problem with handling waste materials and drill cuttings is that after the materials are contained in holding tanks the materials will separate into layers with the upper layer containing fluids, a lower layer containing solids, and an intermediate layer containing solids suspended in fluids. This separation also occurs in the containers or tanks that are used to transport the materials to a remote location and storage container where the materials await processing. The separation of the fluids and solids makes it difficult to remove the materials from the containers or tanks.

Angelle, U.S. Pat. No. 5,662,807 discloses an apparatus and method for handling waste comprising an elongated tank having, a longitudinal rail along a top end with a trolley mounted on the rail. An auger is mounted in the tank at one end thereof. A boom ladder is pivotally attached at an upper end to the trolley and has a pump mounted at its lower end with a shovel blade mounted outwardly of the pump. The trolley moves horizontally on the rail and the boom ladder is oscillated and pivoted from a perpendicular position to an angular position relative to the trolley by hydraulic rams. The shovel blade heaps waste in one direction to be picked up by the auger or in an opposite direction as the trolley is moved along the rail while the pump suctions off accumulated liquid. Alternatively, the boom ladder may be pivoted at an angle to place the inlet of the pump within the fluid phase level of the materials while the trolley is moved along the rail.

Angelle, U.S. Pat. No. 5,846,440 discloses an apparatus and method for handling waste comprising an elongated tank having a longitudinal rail along a top end with a trolley mounted on the rail similar to the above described '807 patent but having a vertically oriented auger mounted on the boom ladder. A boom ladder is pivotally attached at an upper end to the trolley and has a pump mounted at its lower end with a shovel blade mounted outwardly of the pump. The trolley moves horizontally on the rail and the boom ladder and attached auger is oscillated and pivoted from a perpendicular position to an angular position relative to the trolley by hydraulic rams. The shovel blade heaps waste in one direction to be picked up by the auger or in an opposite direction as the trolley is moved along the rail while the pump suctions off accumulated liquid. The pump is provided with a single slurry gate that opens or closes a secondary side inlet of the pump. The auger mounted on the boom ladder blends, mixes and disperses the solids into the fluid phase, and directs materials toward the pump. Alternatively, the boom ladder may be pivoted at an angle to place the inlet of the pump within the fluid phase level of the materials while the trolley is moved along the rail.

The apparatus and methods disclosed in U.S. Pat. Nos. 5,662,07 and 5,846,440 discussed above require a specially constructed relatively narrow tank and the pump call only be moved forward and backward and tilted at an angle relative to a vertical axis inside the narrow tank. There is no provision for sideways or lateral movement of the pump. Although the system taught by these patents may be suitable for use in land-based drilling operations, it is not particularly suited for use in offshore drilling operations. The special tank would not fit in the limited space available on a typical offshore drilling rig, the rail system cannot be fitted to conventional offshore rig fixed holding tanks, and the limited fore and aft and tilting movement of the pump would not be effective in removing materials from the conventional wider holding tanks.

The invention herein disclosed solves these problems by providing an environmentally safe apparatus and method for slurrying waste materials and drill cuttings in a tank and transferring the waste materials and drill cuttings from the tank which is particularly suited for offshore drilling operations as well as land based operations. The apparatus includes a pump having a chamber, an inlet opening into the bottom of the chamber, an impeller disposed in the chamber rotatably driven by a motor, an outlet on one side of the chamber for removal of material from the chamber into a discharge line, and circumferentially spaced circulation ports in the chamber side facing in opposed directions. The impeller extends below the chamber and breaks up debris in addition to drawing material into the pump chamber. The circulation ports may be opened or closed independently of one other, or together, to provide an exit from the chamber. The pump may be rotated by a swivel connection and moved and manipulated in the tank from end to end and top to bottom by a crane arm, or it may be suspended by cable or other means. The pump stirs up a slurry by rotating the impeller, opening the circulation ports at least partially so that the material entering the bottom inlet to the chamber and being agitated by the impeller is forced out of the circulation ports so that the material in the tank is stirred for easier pumping. The pump can operate in the stirring mode until the material to be removed is generally homogenous whereupon the circulation ports can be closed, allowing the impeller to direct the slurry through the side outlet of the chamber into the discharge line. The stirring or slurrying mode can be combined with a discharge mode by opening the circulation ports to the degree required to slurrify the material to be pumped while the material is being pumped out through the discharge line. An auxiliary discharge conduit may also be connected with the outlet to discharge material back into the tank to exchange upper fluid layers of the material with lower layers of solids and fluids and enhance the flow of the material being pumped.

SUMMARY OF THE INVENTION

It is therefore an object of the present invention to provide an apparatus and method for slurrying waste materials and drill cuttings in a tank and transfer the materials and drill cuttings from the tank by pumping it through a discharge line into a holding tank on a boat or other vehicle which conveys the waste materials and drill cuttings to a remote decontamination facility, storage facility re-injection well, or other type of disposal facility.

It is another object of this invention to provide an apparatus and method for slurrying waste materials and drill cuttings in a tank and transfer the materials and drill cuttings from the first tank into a holding tank on a boat or other vehicle which conveys the materials to a remote location and can also be used at the remote location to slurry and transfer the materials from holding tank.

Another object of this invention is to provide an apparatus and method for slurring waste materials and drill cuttings in large quantities (bulk form) and eliminate the need for a large number of small containers.

Another object of this invention is to provide a pump apparatus for slurrying and transferring waste materials and drill cuttings from a tank wherein the pump has an impeller with blades extending beneath the pump inlet that serve to break up large lumps of debris in the material being pumped as well as to draw the material into the pump chamber.

Another object of this invention is to provide a pump apparatus for slurrying, and transferring waste materials and drill cuttings from a tank which pump has a plurality of circulation ports which can be opened independently of on, other, or together to allow the pump to stir up a slurry in the tank and circulate it until it is generally homogeneous for easier pumping.

Another object of this invention is to provide a pump apparatus for slurrying and transferring waste materials and drill cuttings from a tank which pump has circulation ports disposed to equalize the forces exerted on the pump while it is in a slurrying mode.

Another object of this invention is to provide a pump apparatus for slurrying and transferring waste materials and drill cuttings from a tank which pump has a plurality of circulation ports that can be opened to selective extents to combine the slurrying mode with a discharge mode to slurrify or stir the material to be pumped while the material is being pumped out through the discharge line.

Another object of this invention is to provide a pump apparatus for slurrying and transferring waste materials and drill cuttings from a tank which pump has a discharge conduit with an outlet for discharging material back into the tank, so as to enhance the flow of the material being pumped and to exchange the upper layer of the material in the tank with the lower layers.

Another object of this invention is to provide a pump apparatus for slurrying and transferring waste materials and drill cuttings that has a swivel associated with it to allow rotation of the pump in a tank.

Another object of this invention is to provide a pump apparatus for slurrying and transferring waste materials and drill cuttings that can be mounted on a hydraulically or mechanically operated arm such as a crane arm for manipulation the pump in a tank to allow the material to be slurrified from top to bottom uniformly by movement of the pump through the material to be slurryed and pumped.

Another object of this invention is to provide a pump apparatus for slurrying and transferring waste materials and drill cuttings that can be suspended by cable or other means to lower it into a tank and has resilient discharge piping to allow free movement of the pump.

A further object of this invention is to provide a pump apparatus that does not require a specially constructed tank and may be used with various existing conventional tanks for slurrying and transferring waste materials and drill cuttings contained in the tanks.

A still further object of this invention is to provide a pump apparatus for slurrying and transferring waste materials and drill cuttings from a tank which is simple in construction, and rugged and reliable in operation.

Other objects of the invention will become apparent from time to time throughout the specification and claims as hereinafter related.

The above noted objects and other objects of the invention are accomplished by the present apparatus and method for slurrying waste materials and drill cuttings in a tank and transferring the waste materials and drill cuttings from the tank. The apparatus includes a pump having a chamber, an inlet opening into the bottom of the chamber, an impeller disposed in the chamber rotatably driven by a motor, an outlet on one side of the chamber for removal of material from the chamber into a discharge line and circumferentially spaced circulation ports in the chamber side facing in opposed directions. The impeller extends below the chamber and breaks up debris in addition to drawing material into the pump chamber. The circulation ports may be opened or closed independently of one other, or together, to provide an exit from the chamber. The pump may be rotated by a swivel connection and moved and manipulated in the tank from end to end and top to bottom by a crane arm, or it may be suspended by cable or other means. The pump stirs up a slurry by rotating the impeller, opening the circulation ports at least partially so that the material entering the bottom inlet to the chamber and being agitated by the impeller is forced out of the circulation ports so that the material in the tank is stirred for easier pumping. The pump can operate in the stirring mode until the material to be removed is generally homogenous, whereupon the circulation ports can be closed, allowing the impeller to direct the slurry through the side outlet of the chamber into the discharge line. The stirring or slurrying mode can be combined with a discharge mode by opening the circulation ports to the degree required to slurrify the material to be pumped while the material is being pumped out through the discharge line. An auxiliary discharge conduit may also be connected with the outlet to discharge material back into the tank to exchange upper fluid layers of the material with lower layers of solids and fluids and enhance the flow of the material being pumped.

DESCRIPTION OF THE PREFERRED EMBODIMENTS

Figure 1B:
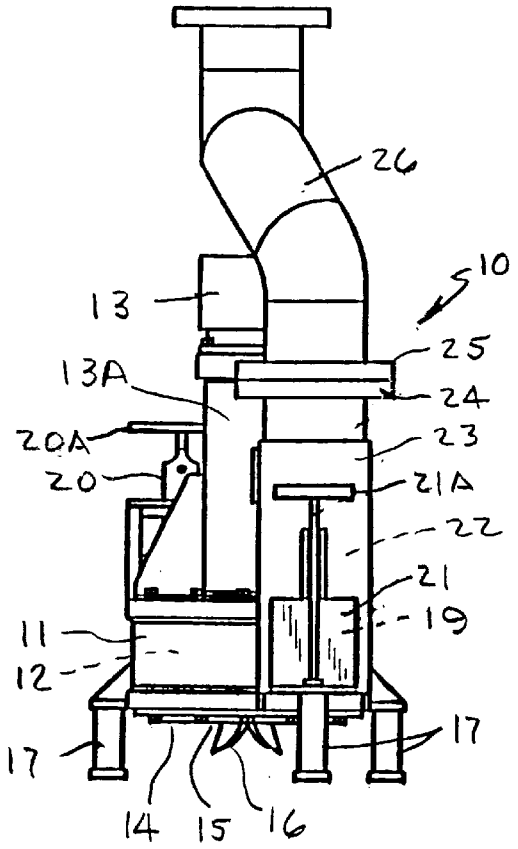
FIGS. 1A, 1B, 1C are left side, front, and rear elevation views, respectively, of the pump apparatus in accordance with the present invention.
Figure 1A:
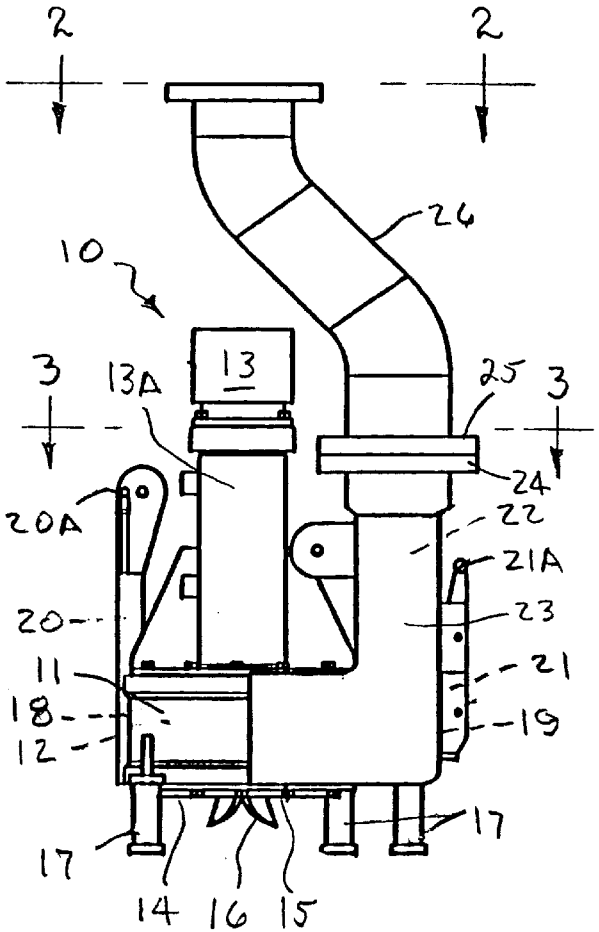
Figure 1C:
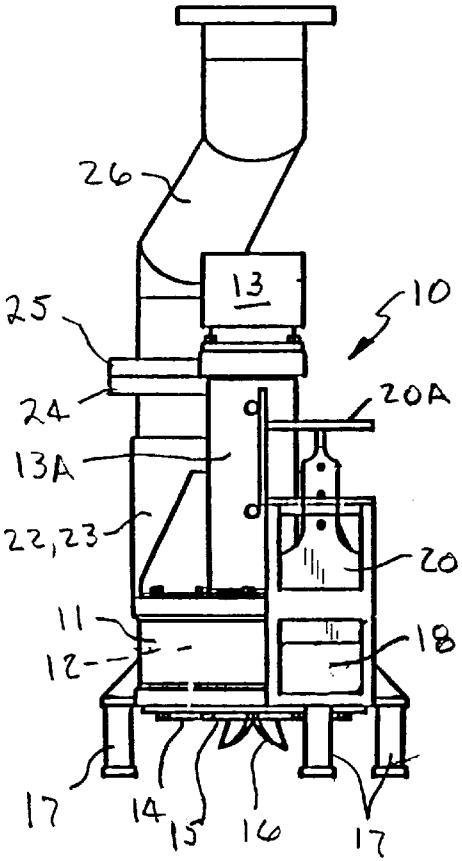
Figure 2:
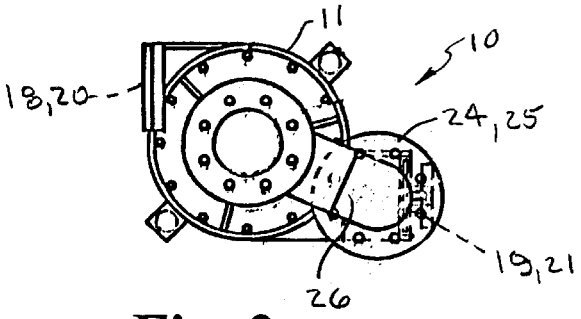
FIG. 2 is a top plan view of the pump apparatus taken along line 2—2 of FIG. 1A.
Figure 3:
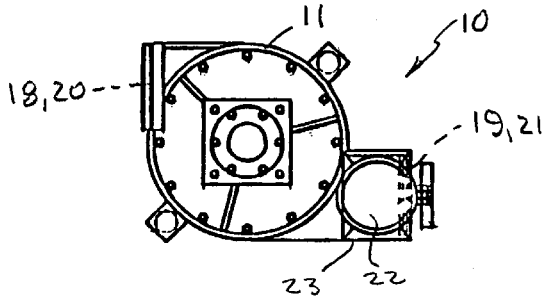
FIG. 3 is a top plan view of the pump apparatus taken along line 3—3 of FIG. 1A showing the apparatus with the pump motor and discharge conduit removed.
Figure 4:
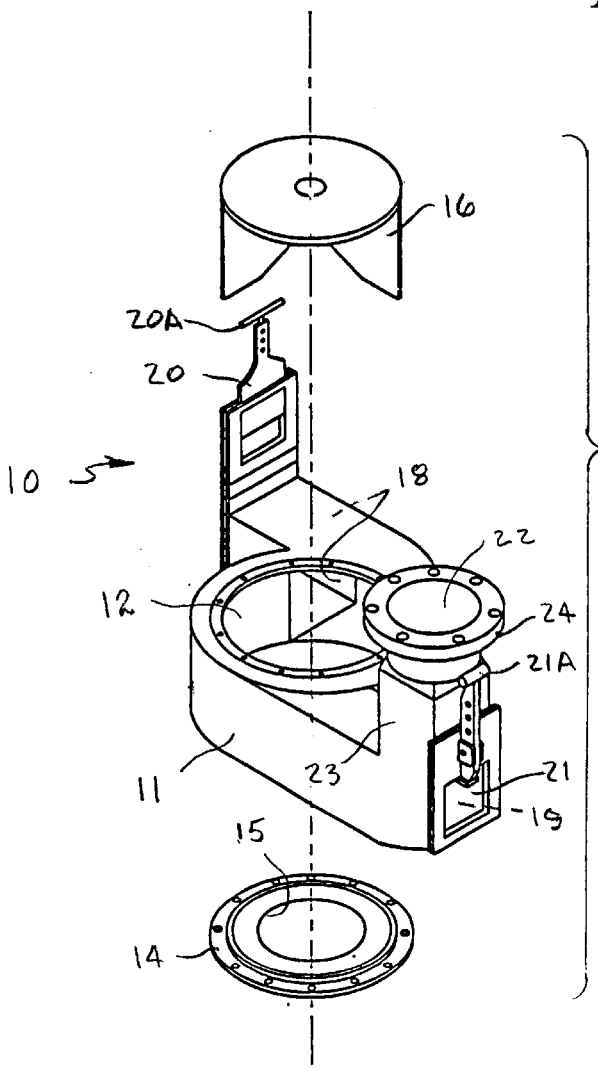
FIG. 4 is an exploded perspective view of the pump housing, bottom plate, and impeller in an unassembled condition.

Referring now to FIGS. 1A, 1B, 1C, 2, 3, and 4, of the drawings, there is shown a pump 10 having a housing 11 with cylindrical chamber 12 (seen in FIG. 4). A drive motor 13 and bearing assembly 13A is secured to the top end of the pump housing 11 and encloses the open top end of the cylindrical chamber 12. A bottom plate 14 is secured to the bottom end of the pump housing 11 and has a central opening that defines the inlet 15 into the cylindrical chamber 12. An impeller 16 connected to the drive shaft of the motor 13 is rotatably disposed in the cylindrical chamber 12, and a lower portion of the blades of the impeller extend downwardly through the inlet opening 15 and terminate a distance below the inlet. Legs 17 are secured to the sides of the pump housing 11 and extend downwardly beyond the lower portion of the blades of the impeller 16.

A pair of circulation ports 18,19 formed in the side wall of the cylindrical chamber 12 extend laterally outwardly from opposite sides of the pump housing 11. The circulation ports 18,19 are circumferentially spaced apart at approximately 180°. A pair of sluice gates 20,21 are slidably mounted on the pump housing to open and close fluid communication through the circulation ports 18,19. The gates 20,21 are raised or lowered to different extents by sluice levers 20A, 21A to expose a desired area of the circulation ports 18,19. It should be understood that the sluice gates 20,21 may be powered by hydraulic or pneumatic means as desired, and may be remotely controlled.

A discharge outlet opening 22 is formed in the side will of the cylindrical chamber 12 to facilitate centrifugal expulsion of the material by the impeller 16 and is adjoined in fluid communication with an outlet conduit 23. The discharge outlet 22 and outlet conduit 23 extend outwardly and upwardly from the cylindrical chamber 12 and a flange 24 is secured on the upward facing end of the outlet conduit 23 which connects to a mating flange 25 of a generally S-shaped discharge conduit 26. It should be understood that the flange 24 of the discharge outlet conduit 23 may be eliminated and the discharge outlet conduit 23 and discharge conduit 26 may be constructed as one piece.

As described hereinafter, the pump 10 is placed into, and manipulated in a tank containing the waste materials and drill cuttings. In operation, the motor 13 rotates the impeller 16 in the pump chamber 12. The portion of the blades of the impeller 16 extending outside the inlet 15 of the chamber 12 serve to break up large lumps of debris. The legs 17 keep the lower portion of the impeller blades 16 off the bottom of the tank preventing damage to them, and keep the pump inlet 15 free from large lumps of debris which may occlude it. The circulation ports 18,19 can be opened by the gates 20,21 so that the impeller 16 discharges the material centrifically through the circulation ports and back into the tank in opposite directions. This can be useful in slurrifying a non-homogenous material before it is ready to be pumped. Once the material to be pumped is generally homogenous, the circulation ports 18,19 can be closed by the oates 20,21 so that the impeller 16 drives the fluid centrifically outward from the side wall of the chamber 12 into the outlet 22 and through the outlet conduit 23 to the discharge conduit 26.

The discharge conduit 26 can be connected by conventional means to a discharge hose (not shown) whose outlet(s) terminates in a holding tank on a boat or other vehicle which conveys the waste materials and drill cuttings recovered from the wellbore to a decontamination facility, storage facility, re-injection well, or other type of disposal or processing facility. One or more hydraulic, electric, gas or diesel powered booster pumps may also be installed in the discharge line to facilitate moving the material long distances.

Figure 5:
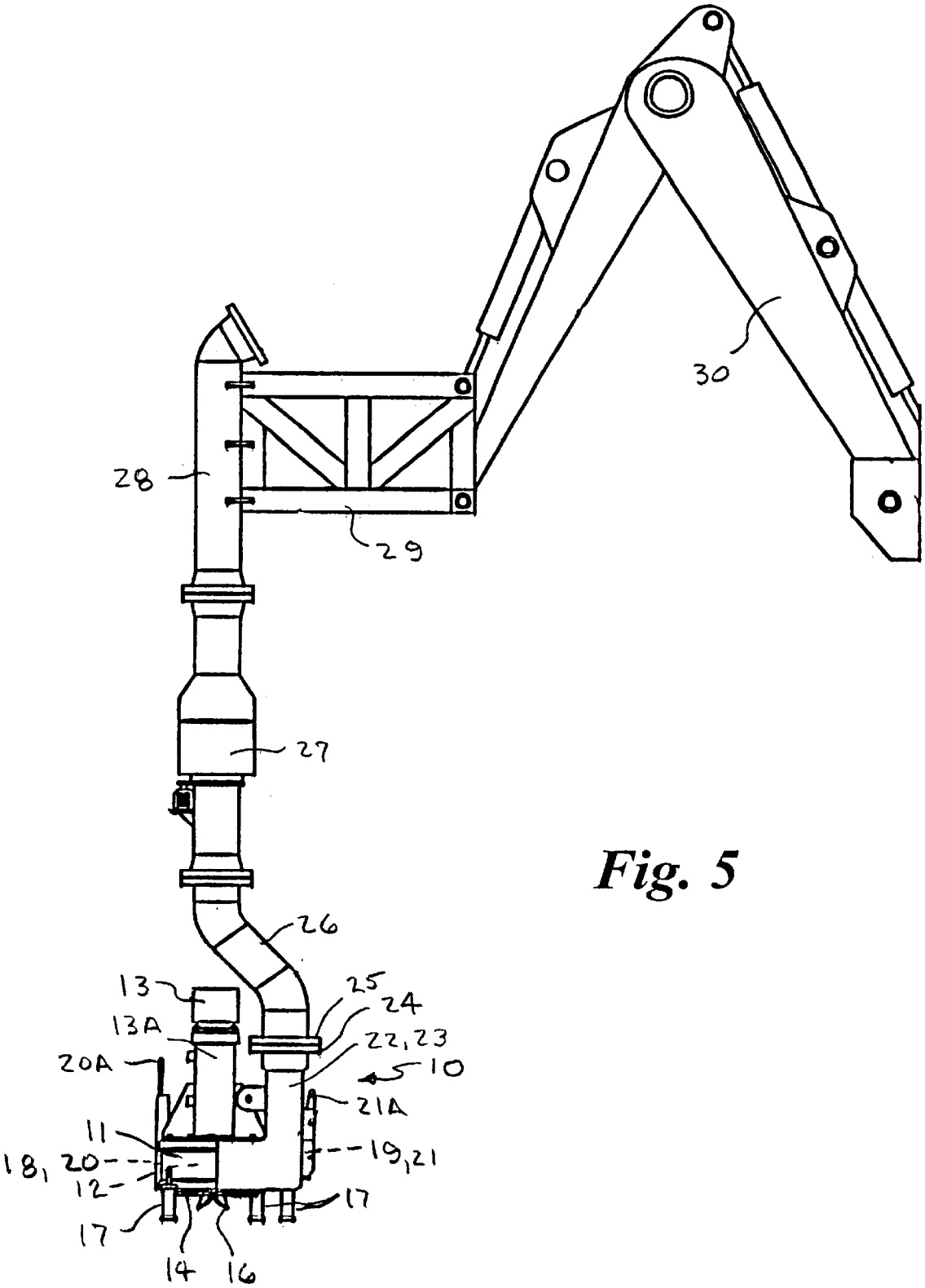
FIG. 5 is a side elevation view showing the pump supported on a crane arm.

FIG. 5 shows an embodiment of the pump 10 wherein the discharge conduit 26 is connected to a motorized swivel joint 27 by which the pump 10 can be rotated in a tank to access all areas of the tank floor. Another section of discharge conduit 28 is secured above the swivel joint 27 and attached to a mounting frame 29 which is connected to a crane arm 30. The crane arm 30 may be mounted on a structural component of the rig adjacent to a holding tank or other suitable structure. The crane arm 30 is used to place the pump 10 into a tank, to move it from one end of the tank to the other, to raise and lower it within the tank to access various levels in the tank, and to remove it from one tank and place it in another tank.

Figure 6B:
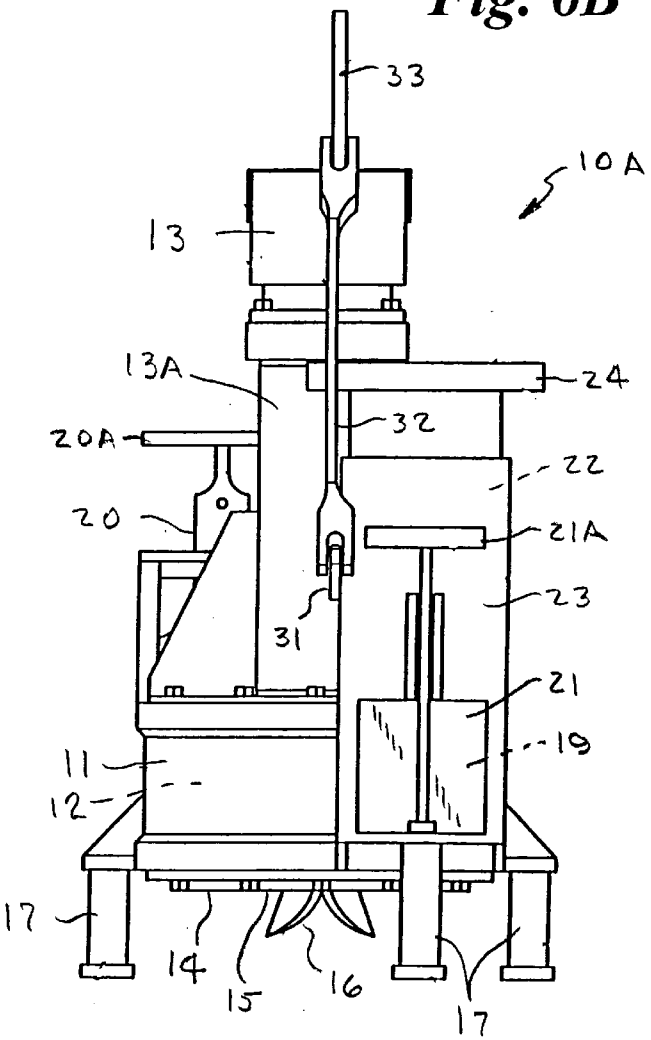
FIGS. 6A and 6B are left side and front elevations of an embodiment of the pump apparatus having a lifting eye.
Figure 6A:
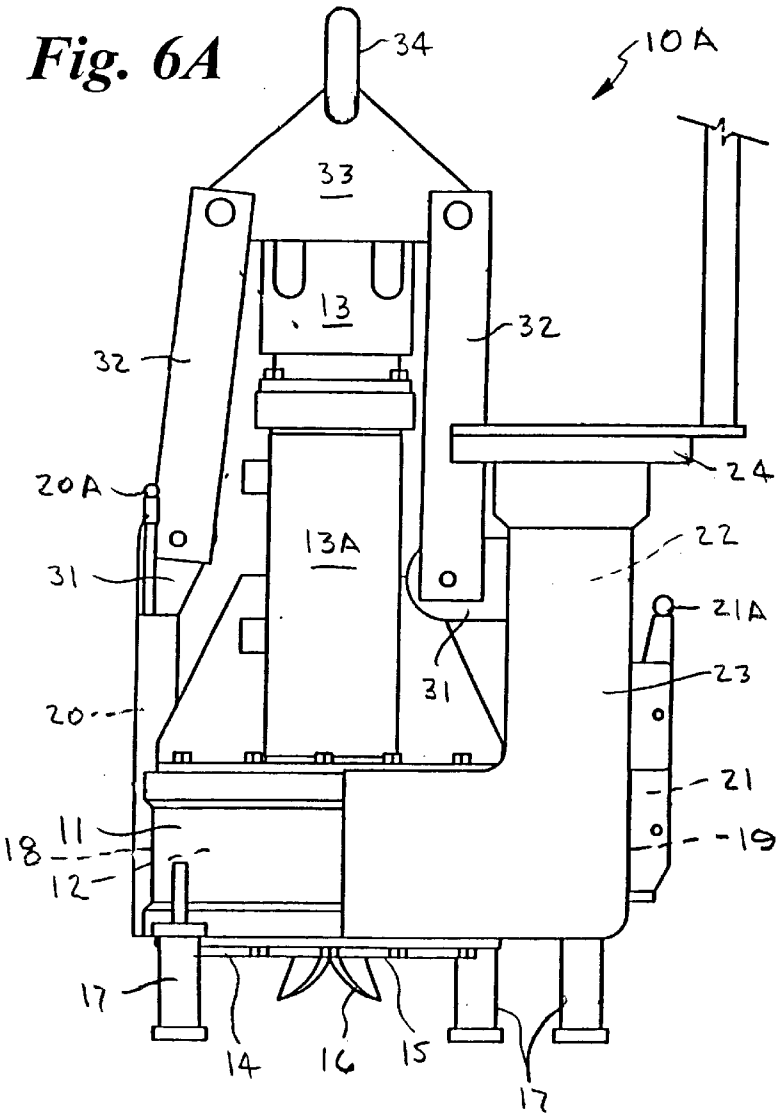
Figure 7:
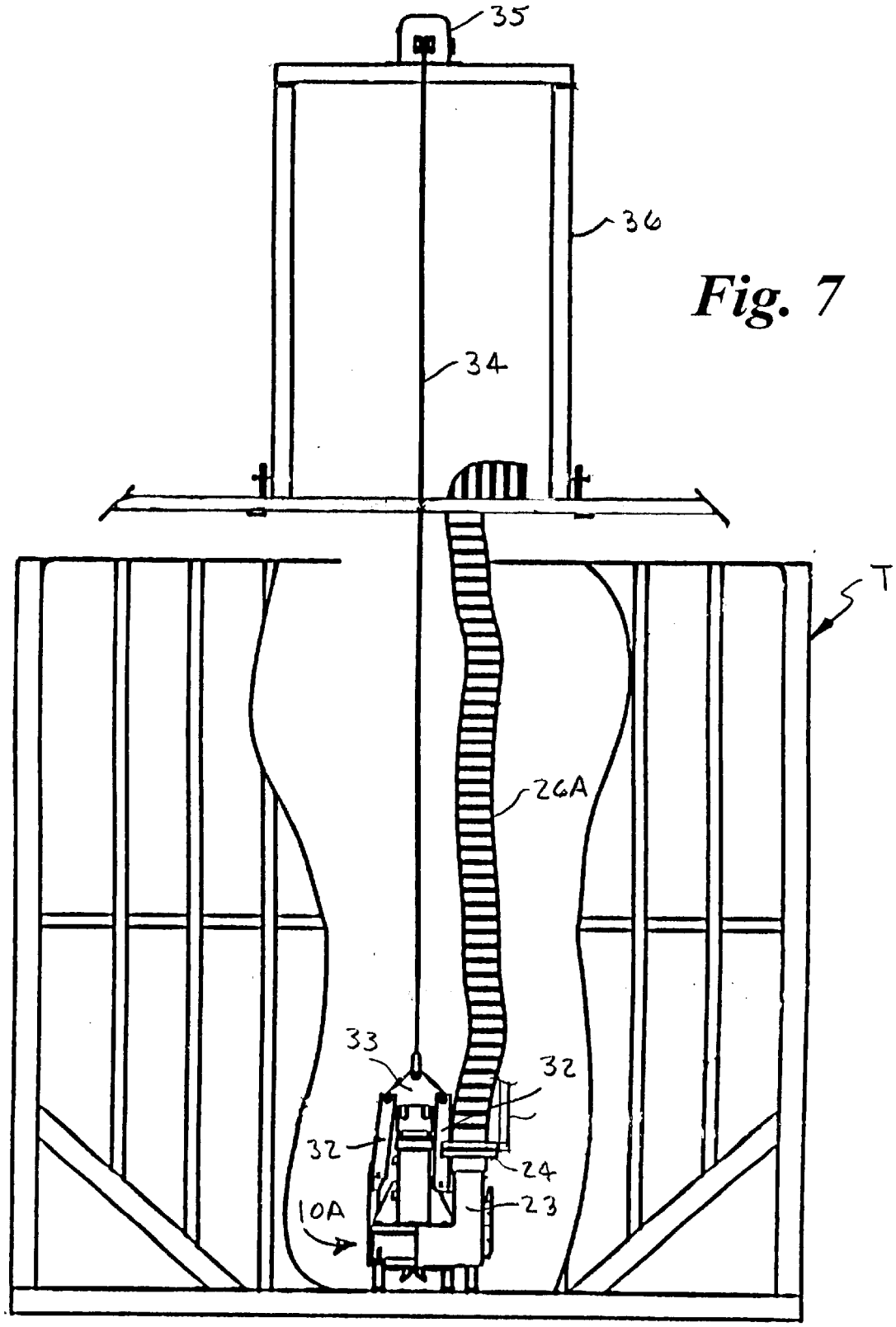
FIG. 7 is a left side elevation showing the pump embodiment of FIGS. 6A and 6B suspended in a tank by a cable and winch and having a flexible discharge conduit.

FIGS. 6A, 6B, and 7 show a modified embodiment of the pump 10A having like features as the pump 10. The common features are assigned the same numerals of reference but will not be described again in detail. The pump 10A has a pair of mounting brackets 31 secured to the housing 11, with a pair of stabilizer bars 32 each pivotally connected at one end to a respective mounting bracket, and connected at their other ends to a lifting eye 33 to which a cable 34 for suspending the pump can be attached so as to raise and lower the pump in a tank, and to allow it to be moved around within the tank. As shown in FIG. 7, the pump 10A can be lowered into a tank T on a cable 34 supported by a winch 35 mounted on a frame 36. The frame 36 may be mounted on a structural component of the rig adjacent to a holding tank or other suitable structure. A flexible discharge conduit 26A may be connected at one end to the flange 24 of the outlet conduit 23 and its other end connected in fluid communication with a holding tank on a boat or other carrier.

Figure 8:
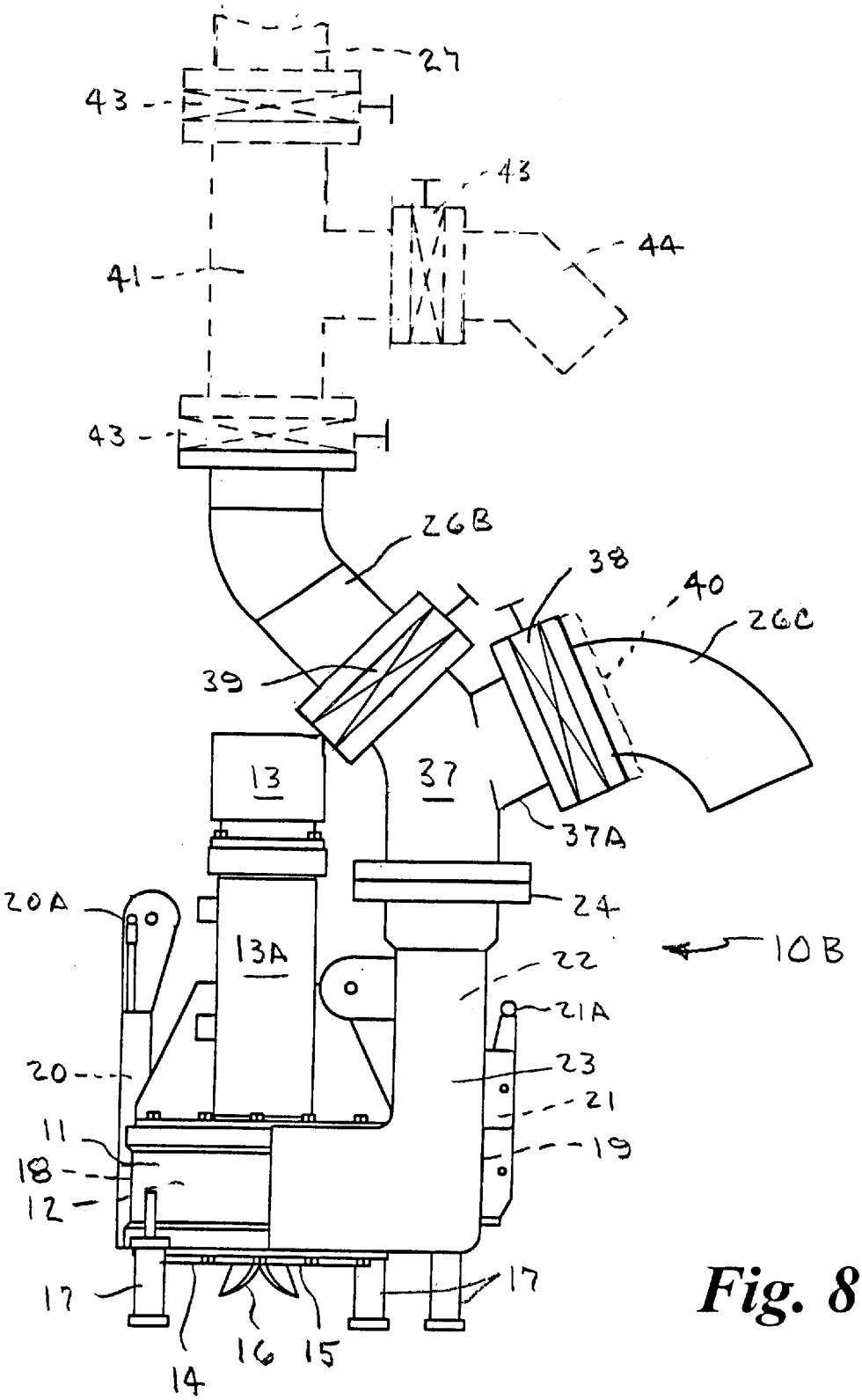
FIG. 8 is a left side elevation of an embodiment of the pump apparatus having an auxiliary discharge conduit for directing materials back into a tank.

FIG. 8 shows a side view of another modification of the pump 10B having like parts as the pump 10 which will not be described further here, but which are designated by the same numerals of reference. In this modification, the discharge conduit 26B leading from the flange 24 of the outlet conduit 23 has a tee or Y-fitting 37 installed in the discharge line to allow flow through the discharge conduit 26A and/or flow through the leg 37A of the fitting 37. Valves 38 and 39 (represented schematically) are provided on the leg 37A and above the fitting 37, respectively, so as to allow or restrict flow through the respective portions of the discharge conduit 26B or leg 37A. A curved section of discharge conduit 26C is connected to the valve 38. The conduit 26C is open-ended and discharges material out of the pump and back into the tank or other container from which the material is being pumped, so as to enhance the flow of the material being pumped and to exchange the upper layer of the material with the lower layers.

By closing the valve 39 above the fitting 37, and opening the valve 38 on the leg 37A, the pump displaces fluid through the discharge conduit 26B only as far as the closed valve 39, and thereafter discharges it back into the container from which it was pumped via the leg 37A and open-ended conduit 26C. It should be noted that the open end of the conduit 26C is spaced above the inlet 15 at the bottom of the pump 10B, and thus this configuration allows the material being pumped to be recirculated through the pump chamber 12 and through the outlet 22 and outlet conduit 23 out through the leg 37A and back into the container or tank in order to homogenize the material further if desired. The discharge conduit 26C may alternatively be connected to the valve 38 on the leg 37A of the fitting 37 by a swivel connection 40 (represented in dashed line) to allow the direction in which the open end of the conduit 26C faces to be adjusted so that the material discharged from the pump when the valve 38 is open can be distributed over a wide area in the container or tank from which the material is being pumped.

If desired, the valve 38 on the leg 37A can be closed, and the valve 39 at the top of the fitting 37 can be opened to allow pumping as normal, and in certain cases, both valves can be fully or partially open to various extents as desired, in order to control the extent of material removed via the discharge conduit 26B and the amount of material recirculated via the leg 37A. It should be understood that the valves may be operated by hydraulic or pneumatic means as desired, and may be remotely controlled.

Providing the modified pump 10B shown in FIG. 8 both with circulation ports 18,19 and with the auxiliary discharge leg 37A produces an additional advantage in that it allows the sluice gates 20,21 to be opened when the pump is deep in the solids layer of a tank of material to slurrify the thick viscous lower layers, and the conduit 26C oil the leg 37A can be used to expel material with some force in order to increase the turbulence at the surface of the material being pumped, thereby increasing the homogeneity of the material at two locations and making it easier to pump through the discharge conduit 26B. The advantage of the elevated position of the conduit 26C on the leg 37A and its ability to swivel is that the material discharged through the leg 37A can be expelled over a wide area some distance away from the pump enabling, larger pits and tanks to be treated without excessive movement of the pump within the tank.

As shown in dashed line, the pump 10B may be provided with a tee or Y-fitting 41 and valves 43 at any location in the discharge line, with the fitting 41 connected with a conduit 44 having an outlet that can be positioned to discharge materials back into the tank. It should be understood that the embodiment of FIG. 8 having an auxiliary discharge conduit for returning materials to the tank may also be provided with a swivel joint (as shown in FIG. 5) above or below the fitting 41 and may be manipulated a crane arm or by a winch and cable (as shown in FIG. 7).

It should also be understood that booster pumps may also be disposed in the discharge line so that the pump can be used to move material long distances. The same pump and impeller as described in the examples above can be used as a booster pump in the discharge line, by modifying it to remove the sluice gates and using a hydraulic, electric, gas or diesel motor, as can be used for the pump as shown in the embodiments described.

In operation, the pump 10, 10A, 10B is used for slurrying and conveying drill cuttings in a tank and transferring them from the tank. During the slurrying or stirring operation, the circulation ports 18,19 may be opened independently from one another, or together, by moving the respective sluice gates 20,21 in order to provide an exit from the pump chamber 12. This allows the rotating impeller 16 to stir up a slurry in the chamber 12. With the circulation ports 18,19 at least partially open, the material entering the inlet 15 to the chamber 12 and being agitated by the impeller 16 is forced out of the circulation ports so that the material in the tank is stirred for easier pumping. The pump can operate in the stirring mode for sufficient time until the material to be removed is generally homogenous, whereupon the circulation ports can be closed, allowing the impeller to direct the slurry through the outlet 22 of the chamber into the discharge conduit 26, 26A, 26B.

The provision of two circulation ports, and particularly when they are approximately 180° apart from one another equalizes the forces exerted on the pump while it is in a slurrying mode. The slurrying mode can be combined with a discharge mode by simply opening the circulation ports to the degree required to slurry the material to be pumped while the material is being pumped out through the discharge line.

In addition to using the present apparatus to slurry and transfer waste material and drill cuttings from holding tanks located at the well site such as on an offshore drilling rig to holding tanks on a vehicle such as a ship or boat, the apparatus may also be used on the transporting vehicle or on land to slurry and transfer the materials from the transported tanks to land based tanks at the processing or storage facility.

While this invention has been described fully and completely with special emphasis upon preferred embodiments, it should be understood that within the scope of the appended claims the invention may be practiced otherwise than as specifically described herein.

What is claimed is:

1. An apparatus for slurrying waste materials and drill cuttings in a tank and transferring them therefrom, comprising:

pump means having a chamber, an inlet opening into said chamber, an impeller rotatably disposed in said chamber and being driven by a motor to draw waste materials and drill cuttings contained in a tank into said chamber, a discharge outlet on one side of said chamber, discharge conduit means connected with said discharge outlet for conveying waste materials and drill cuttings from said chamber to a location outside of said tank;

manipulating means operatively associated with said pump means for moving said pump means vertically, horizontally, and laterally within said tank, and swivel means for rotating said pump means on a vertical axis thereof within said tank.

2. The apparatus according to claim 1, wherein said manipulating means is operatively associated with said pump means for placing said pump means into said tank and removing it therefrom.

3. The apparatus according to claim 1, further comprising;

at least one circulation port on a side of said pump means chamber in fluid communication therewith; and gate means operatively associated with said circulation port to selectively open and close fluid flow between said chamber and the exterior of said pump means so that in a closed position waste materials and drill cuttings are discharged from said chamber only through said discharge outlet and said discharge conduit means, and in an open position a portion of waste materials and drill cuttings are circulated in a continuous path from said inlet into said chamber, through said circulation port, and discharged back into said tank to agitate and stir up waste materials and drill cuttings contained therein while another portion of said waste materials and drill cuttings are discharged from said chamber through said discharge outlet and said discharge conduit means.

4. The apparatus according to claim 3, wherein said gate means is operatively associated with said circulation port to fully open fully close, and to partially open and close fluid flow between said chamber and the exterior of said pump means to selectively control the amount of waste materials and drill cuttings that are discharged from said chamber, and the amount of waste materials and drill cuttings that are circulated in said continuous path and discharged back into said tank.

5. The apparatus according to claim 3, wherein there are a plurality of said circulation ports disposed in circumferentially spaced relation to direct fluid flow in different directions; and said gate means being operatively associated with each of said circulation ports to open and close fluid flow through selected said circulation ports independently so that in an open position portions of waste materials and drill cuttings are circulated in a continuous path from said inlet into said chamber, through said selected circulation ports, and discharged back into said tank in different directions to agitate and stir up waste materials and drill cuttings contained therein while another portion of said waste materials and drill cuttings are discharged from said chamber through said discharge outlet and said discharge conduit means.

6. The apparatus according to claim 1, wherein said impeller has extensions extending below said chamber inlet to break up large clumps of waste material and drill cuttings and prevent clogging of said inlet.

7. The apparatus according to claim 1, further comprising;

auxiliary discharge means connected in fluid communication with said discharge conduit means and having an outlet positioned to direct fluid flow onto the top surface of waste materials and drill cuttings in said tank so that a portion of waste materials and drill cuttings being discharged are discharged into the top surface to agitate and stir up waste materials and drill cuttings contained in said tank.

8. The apparatus according to claim 7, wherein said auxiliary discharge means is movably connected with said discharge conduit means for selectively positioning its said outlet to distribute said portion of waste materials and drill cuttings being discharged into the top surface over a wide area within said tank.

9. The apparatus according to claim 7, further comprising;

valve means operatively associated with said auxiliary discharge means to selectively open and close fluid flow therethrough so that in a closed position waste materials and drill cuttings are discharged only through said discharge conduit means, and in an open position a portion of waste materials and drill cuttings being discharged through said discharge conduit means are discharged through said auxiliary discharge means back into the top surface of waste materials and drill cuttings contained in said tank.

10. The apparatus according to claim 9, wherein said valve means comprises first valve means operatively associated with said discharge conduit means to fully open, fully close, and to partially open and close fluid flow therethrough, and second valve means operatively associated with said auxiliary discharge means to fully open, fully close, and to partially open and close fluid flow therethrough;

said first and second valve means being operated to selectively control the amount of waste materials and drill cuttings that are discharged through said discharge conduit means to a location outside of said tank, and the amount of waste materials and drill cuttings that are discharged through said auxiliary discharge means back into the top surface of waste materials and drill cuttings contained in said tank.

11. A method for slurrying waste materials and drill cuttings in a tank and transferring them therefrom, comprising the steps of:

placing a pump apparatus into a tank containing waste materials and drill cuttings, said pump apparatus having a chamber, an inlet opening into said chamber, an impeller rotatably disposed in said chamber and being driven by a motor to draw waste materials and drill cuttings into said chamber, a discharge outlet on one side of said chamber, and discharge conduit means connected with said discharge outlet to convey waste materials and drill cuttings to a location outside of said tank;

operating said pump apparatus to draw said waste materials and drill cuttings contained in said tank into said chamber and discharge them through said discharge outlet and said discharge conduit means to convey them to a location outside of said tank; and manipulating said pump apparatus during the pumping operation by raising and lowering it vertically and moving it horizontally and laterally within said tank as required to position said inlet in selected levels of liquid and solid phases of said waste materials and drill cuttings, and rotating said pump apparatus about a vertical axis thereof within said tank.

12. The method according to claim 11, including the further step of removing said pump apparatus from said tank.

13. The method according to claim 12, including the further step of after removing said pump apparatus from said tank, placing said pump apparatus into a second tank containing waste materials and drill cuttings; and thereafter repeating the recited steps.

14. The method according to claim 11, wherein said pump apparatus has at least one circulation port on a side of said pump chamber in fluid communication therewith and gate means operatively associated with said circulation port to open and close fluid flow between said chamber and the exterior of said pump apparatus; and said step of operating said pump apparatus includes:

selectively moving said gate means between a closed position to close off flow through said circulation port and an open position to circulate a portion of said waste materials and drill cuttings in a continuous path from said inlet into said chamber, through said circulation port, and discharge them back into said tank to agitate and stir up waste materials and drill cuttings contained therein while another portion of said waste materials and drill cuttings are being discharged from said chamber through said discharge outlet and said discharge conduit means.

15. The method according to claim 14, wherein said step of moving said gate means includes moving said gate means between said closed and open positions to selectively control the amount of waste materials and drill cuttings that are discharged from said chamber, and the amount of waste materials and drill cuttings that are circulated in said continuous path and discharged back into said tank.

16. The method according to claim 14, wherein said pump apparatus has a plurality of said circulation ports disposed in circumferentially spaced relation, and said gate means being operatively associated with each of said circulation ports to open and close fluid flow through selected said circulation ports independently; and said step of selectively moving said gate means between said closed position and said open position to circulate a portion of said waste materials and drill cuttings includes:

opening selected ones of said circulation ports to discharge waste materials and drill cuttings from said chamber back into said tank in different directions to agitate and stir up waste materials and drill cuttings contained therein.

17. The method according to claim 11, wherein said pump apparatus has auxiliary discharge means connected in fluid communication with said discharge conduit means with an outlet positioned to direct fluid flow onto the top surface of waste materials and drill cuttings in said tank; and said step of operating said pump apparatus includes:

selectively directing a portion of the waste materials and drill cuttings being discharged through said auxiliary discharge means into the top surface to agitate and stir up waste materials and drill cuttings contained in said tank.

18. The method according to claim 17, wherein said step of selectively directing said portion of said waste materials and drill cuttings through said auxiliary discharge means includes selectively positioning said auxiliary discharge means outlet to distribute said portion of waste materials and drill cuttings being discharged into the top surface over a wide area within said tank.

19. The method according to claim 17, wherein said step of selectively directing a portion of the waste materials and drill cuttings through said auxiliary discharge means includes selectively controlling the amount of waste materials and drill cuttings that are discharged through said discharge conduit means to a location outside of said tank, and the amount of waste materials and drill cuttings that are discharged through said auxiliary discharge means back into the top surface of waste materials and drill cuttings contained in said tank.

20. A method for slurrying waste materials and drill cuttings in a tank and transferring them therefrom, comprising the steps of:

placing a pump apparatus into a tank containing waste materials and drill cuttings, said pump apparatus having a chamber, an inlet opening into said chamber, an impeller rotatably disposed in said chamber and being driven by a motor to draw waste materials and drill cuttings into said chamber, a discharge outlet on one side of said chamber and a discharge conduit means connected with said discharge outlet to convey said waste materials and drill cuttings to a location outside of said tank;

operating said pump apparatus to draw said waste materials and drill cuttings contained in said tank into said chamber and discharge them through said discharge outlet and said discharge conduit means to convey them to a location outside of said tank;

manipulating said pump apparatus during the pumping operation by raising and lowering it vertically and moving it horizontally and laterally within said tank as required to position said inlet in selected levels of liquid and solid phases of said waste materials and drill cuttings;

said pump apparatus having at least one circulation port on a side of said pump chamber in fluid communication therewith, and gate means operatively associated with said circulation port to open and close fluid flow between said chamber and the exterior of said pump apparatus; and selectively moving said gate means between a closed position to close off flow through said circulation port and an open position to circulate a portion of said waste materials and drill cuttings in a continuous path from said inlet into said chamber, through said circulation port, and discharge them back into said tank to agitate and stir up waste materials and drill cuttings contained therein while another portion of said waste materials and drill cuttings are being discharged from said chamber through said discharge outlet and said discharge conduit means.

21. An apparatus for slurrying waste materials and drill cuttings in a tank and transferring them therefrom, comprising:

pump means having a chamber, an inlet opening into said chamber, and impeller rotatably disposed in said chamber and being driven by a motor to draw waste materials and drill cuttings contained in a tank into said chamber, a discharge outlet on one side of said chamber, discharge conduit means connected with said discharge outlet for conveying waste materials and drill cuttings from said chamber to a location outside of said tank;

manipulating means operatively associated with said pump means for moving said pump means vertically, horizontally, and laterally within said tank;

at least one circulation port on a side of said pump means chamber in fluid communication therewith; and gate means operatively associated with said circulation port to selectively open and close fluid flow between said chamber and the exterior of said pump means so that in a closed position waste materials and drill cuttings are discharged from said chamber only through said discharge outlet and said discharge conduit means, and in an open position a portion of waste materials and drill cuttings are circulated in a continuous path from said inlet into said chamber, through said circulation port, and discharged back into said tank to agitate and stir up waste materials and drill cuttings contained therein while another portion of said waste materials and drill cuttings are discharged from said chamber through said discharge outlet and said discharge conduit means.

* * * * *